United States Patent [19]
Williams et al.
[11] 4,318,192
[45] Mar. 9, 1982

[54] VENTILATED TOILET

[76] Inventors: Jack D. Williams, P.O. Box 198, Gold Bar, Wash. 98251; Howard V. Banasky, 1401 N. 26th, Renton, Wash. 98055

[21] Appl. No.: 89,763

[22] Filed: Oct. 31, 1979

[51] Int. Cl.[3] ..... E03D 9/04; E03D 9/052
[52] U.S. Cl. ..... 4/213; 4/216; 4/349; 4/351
[58] Field of Search ..... 4/209, 211, 213–218, 4/347–352

[56] References Cited

U.S. PATENT DOCUMENTS

| | | | |
|---|---|---|---|
| 1,342,716 | 6/1920 | Johnston | 4/213 |
| 1,424,955 | 8/1922 | Van Eck | 4/213 |
| 1,740,246 | 12/1929 | Kosser | 4/348 |
| 1,887,498 | 11/1932 | Connors | 4/213 |
| 1,911,032 | 5/1933 | Minkler | 4/213 |
| 1,931,052 | 10/1933 | Baither | 4/213 |
| 2,058,436 | 10/1936 | Friel | 4/213 |
| 2,126,131 | 8/1938 | Orebaugh | 4/213 |
| 2,203,111 | 6/1940 | Stebbing et al. | 4/213 |
| 2,227,920 | 1/1941 | Baither | 4/213 |
| 2,575,778 | 11/1951 | Wilson | 4/213 |
| 2,777,137 | 1/1957 | McFadden | 4/213 |
| 2,778,033 | 1/1957 | Mojauskos | 4/213 |
| 2,985,890 | 5/1961 | Baither | 4/213 |
| 3,087,168 | 4/1963 | Huso | 4/213 |
| 3,102,275 | 9/1963 | Raymond | 4/213 |
| 3,120,006 | 2/1964 | Knappe | 4/213 |
| 3,122,757 | 3/1964 | Sowards | 4/213 |
| 3,192,539 | 7/1965 | Martz | 4/213 X |
| 3,495,282 | 2/1970 | Taggart | 4/213 |
| 3,593,901 | 5/1976 | Poister et al. | 4/213 |
| 3,763,505 | 10/1973 | Zimmerman | 4/213 |
| 3,805,304 | 4/1974 | Ikehata | 4/213 X |
| 3,913,150 | 10/1975 | Poister et al. | 4/213 |
| 3,938,201 | 2/1976 | McGrew | 4/213 |
| 4,007,498 | 2/1977 | Pearson | 4/213 |
| 4,044,408 | 8/1977 | Pearson | 4/213 |

FOREIGN PATENT DOCUMENTS

| | | | |
|---|---|---|---|
| 917933 | 2/1963 | United Kingdom | 4/213 |

*Primary Examiner*—Stuart S. Levy
*Attorney, Agent, or Firm*—Christensen, O'Connor, Johnson & Kindness

[57] ABSTRACT

A ventilated toilet includes a flapper valve assembly having coaxial air intake and air discharge tubes, the outer air intake tube being connected at its lower end to the flush discharge outlet of the holding tank of the toilet. The inner tube protrudes downwardly through the flush discharge outlet and through the porcelain wall separating the siphon portion of the toilet waste discharge duct from the flush conduit connecting the flush discharge outlet of the holding tank to the annular water discharge channel in the rim of the toilet bowl. An electric fan withdraws contaminated air from the toilet bowl through the annular discharge channel and upwardly through the annular channel between the inner and outer flapper valve tubes and vents downwardly through the inner tube to the siphon portion of the waste duct to be discharged. A conventional flapper valve is offset from and connected to the outer one of the pair of coaxial tubes.

11 Claims, 3 Drawing Figures

VENTILATED TOILET

BACKGROUND OF THE INVENTION

The present invention relates generally to toilets, and more particularly to ventilated toilets wherein contaminated air from a toilet bowl is removed and disposed of through the sewer line to which the toilet is connected.

A substantial number of prior art references have disclosed ventilated toilets of various types. In general, these ventilated toilets can be broadly categorized into several groups according to their mode of operation. In one rather broad class of ventilated toilets, contaminated air is withdrawn from the toilet bowl and pumped through a filter or other air scrubbing device to deodorize the air prior to its being discharged. An example of this type of toilet is illustrated in U.S. Pat. No. 3,763,505 to Zimmerman. The advantage of this type of toilet is purported to be that the installation of additional ventilation plumbing in the walls of the building is not required. In such toilets the air scrubbing device must be periodically checked and serviced.

In another broad class of ventilated toilets, contaminated air is withdrawn from the toilet bowl and discharged to the outdoors by means of ventilation conduits leading from the toilet. An example is disclosed in U.S. Pat. No. 3,495,282 to Taggart. These types of toilets require the ventilation conduits to be installed in the walls of the building, where they must be connected either to pre-existing air ventilation conduits or provided with an independent discharge outlet. In this type of ventilated toilet, installation of the ventilation conduits may require structural modification of the building.

In a third class of ventilated toilets, contaminated air is withdrawn from the toilet bowl and discharged into the sewer line to which the toilet is connected. It is an improved ventilated toilet of this latter type to which the present invention is addressed.

Prior art ventilated toilets of the latter type have generally required either the installation of a separate, external air conduit system leading to the sewer pipe under the toilet, as disclosed for example in U.S. Pat. No. 2,985,890 to Baither, or extensive modification of the toilet to provide an internal air discharge conduit passing downwardly through the porcelain toilet stool to the sewer pipe through which contaminated air may be vented, as for example in the toilet disclosed in U.S. Pat. No. 3,120,006 to Knappe. In the former approach, the installation of ventilation plumbing exterior to the toilet stool may require structural modification of the building. On the other hand, the primary disadvantage of the latter approach has been that provision of the requisite internal ventilation conduit must usually be made at considerable additional cost during the manufacture of the porcelain toilet structure, and can rarely be installed at a later date on a pre-existing toilet.

Accordingly, the object and purpose of the present invention is to provide a ventilated toilet having an internal ventilation conduit which can be formed in a conventional, standard toilet at little expense of time or labor. It is another object of the present invention to provide a ventilated toilet mechanism which can be retrofitted to existing conventional toilets.

SUMMARY OF THE INVENTION

In accordance with the present invention, the conventional flapper valve assembly and holding tank overflow tube of a conventional, contemporary toilet-flushing mechanism are replaced with a modified flapper valve assembly including coaxial air intake and air discharge tubes, and an offset flapper valve assembly. The only modification that must be made to a conventional toilet bowl in order for it to accept the modified flapper valve assembly is the drilling of a hole in the porcelain wall between the main siphon of the toilet bowl waste duct and the water feed conduit leading from the flush discharge outlet of the holding tank. The hole will normally be centered on the flush discharge outlet of the holding tank and will connect the flush discharge outlet with the top of the main siphon of the toilet waste duct. Through the drilled hole is passed the air discharge tube, which extends therefrom upwardly and coaxially through the larger, coaxial air intake tube, which intake tube terminates at the discharge outlet of the holding tank. A sealed fan assembly in the holding tank is selectively actuated between flushing cycles to ventilate the toilet bowl. In operation, contaminated air in the toilet bowl is withdrawn through the pre-existing flush water apertures spaced around the inner periphery of the toilet bowl rim and withdrawn therefrom upwardly through the outer, air intake tube of the modified flapper valve assembly. From the top of the air intake tube, the fan assembly pumps the contaminated air downwardly through the central air discharge tube to be discharged into the waste duct of the toilet and thence to the sewer line.

The advantages of the present invention are more fully illustrated by reference to the accompanying figures and the following detailed description.

DESCRIPTION OF THE PREFERRED EMBODIMENT

Figure 1:
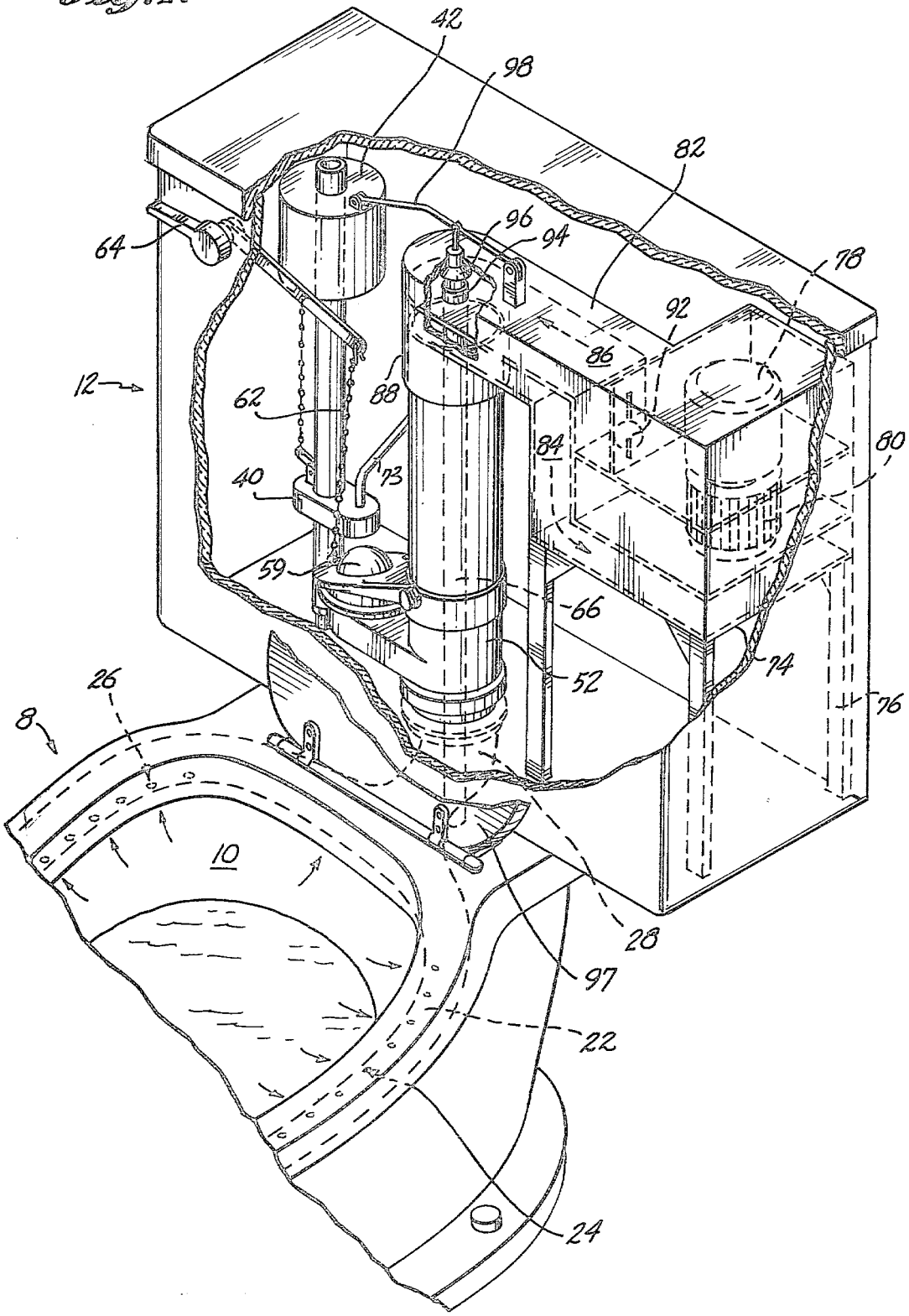
FIG. 1 is an isometric view of the ventilated toilet of the present invention.
Figure 3:
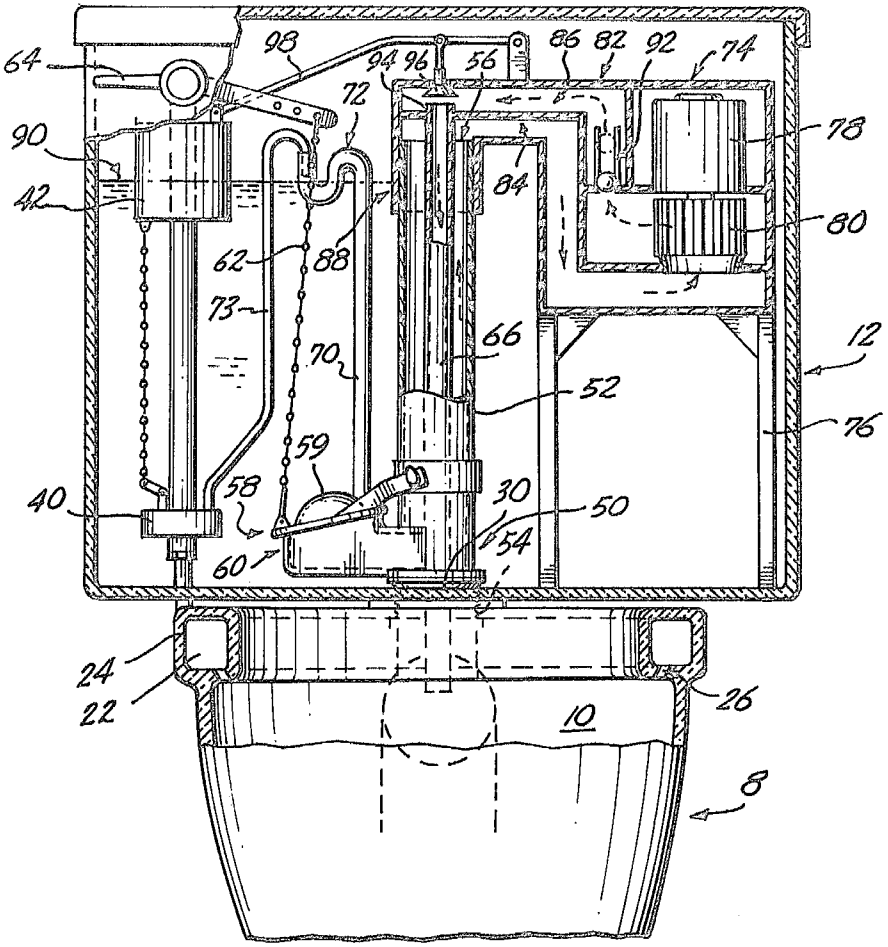
FIG. 3 is a partial, cross-sectional front view of the holding tank and the air discharge system of the present invention.
Figure 2:
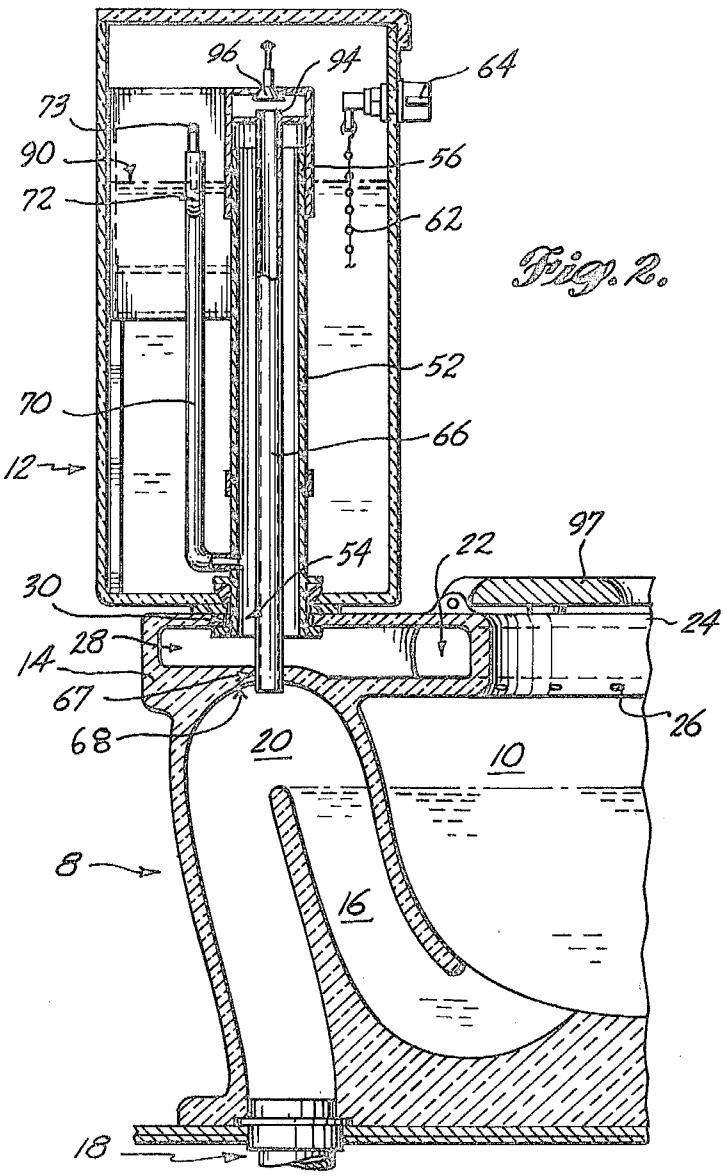
FIG. 2 is a partial, cross-sectional side view of the ventilated toilet of FIG. 1.

The accompanying FIGS. 1 through 3 illustrate a conventional, contemporary toilet as modified to include the ventilation system of the present invention. The toilet includes a conventional toilet stool 8 having a toilet bowl 10, and an associated water holding tank 12. The holding tank 12 rests upon a rearwardly extending portion 14 of the toilet stool 8. The bottom of the toilet bowl 10 opens into a conventional internal waste discharge duct 16, which is in turn connected at its discharge end to a sewer pipe 18. The waste discharge duct 16 includes a conventional siphon portion 20 positioned behind the toilet bowl 10 and below the holding tank 12. The toilet stool 8 further includes an annular flush water discharge channel 22 integrally formed in the toilet bowl rim 24. Multiple water discharge apertures 26 spaced around the inside lower periphery of the toilet bowl rim 24 provide openings for fresh water to be flushed into the toilet bowl 10 from the annular discharge channel 22.

The annular discharge channel 22 in the toilet bowl rim 24 is connected to a water feed conduit 28 extending rearwardly under the holding tank 12 from the rim 24 of the toilet.

The holding tank 12 is typically manufactured separately from the toilet stool 8, there being a tank discharge outlet 30 in the bottom of the holding tank 12 which is centered on and positioned in sealed relationship with the upper end of the conduit 28.

The holding tank 12 includes a conventional water intake valve 40 and a valve float 42 which operate to refill the holding tank 12 and the toilet bowl 10 with fresh water after each flushing cycle. The tank 12 further includes a novel flapper valve assembly 50. The flapper valve assembly 50 includes a relatively large diameter air intake tube 52 which is centered on and extends upwardly from the holding tank discharge outlet 30. The lower end of the intake tube 52 is continuous with and sealed to the opening of the feed conduit 28 by means of a threaded end portion 54. The large diameter air intake tube 52 terminates in an open upper end 56.

Near the lower end of the air intake tube 52 is a laterally offset flapper valve 58. The flapper valve 58 includes a buoyant rubber flapper 59 which is cooperably mated to its associated flapper valve opening 60. The flapper 58 is hinged to the tube 52 and is connected by a chain 62 to the handle 64 of the toilet. The flapper valve 58 operates in a conventional manner to control the discharge of water from the holding tank 12 into the toilet bowl 10.

Inside the large diameter air intake tube 52 is a coaxially positioned, small diameter discharge tube 66. The lower end of the air discharge tube 66 passes downwardly completely through the conduit 28 and through a hole 67 in the porcelain wall 68 between the conduit 28 and the upper siphon portion 20, and opens into the upper siphon portion 20 of the waste duct 16.

Also connected to the lower end of the large diameter air intake tube 52 is a holding tank overflow tube 70 having at its upper end an S-shaped water trap 72. A water feed conduit 73 connects the intake valve 40 to the opening of the S-shaped trap 72. The feed conduit 73 conducts water from the intake valve 40 through the trap 72 and the overflow tube 70 to refill the toilet bowl 10 after each flushing cycle. The S-shaped trap 72 operates to seal the overflow pipe 70 after each flushing cycle so that air is not withdrawn into the air intake tube 52 from the top of the holding tank 12. As a result, the tank 12 and its lid need not be airtight for the ventilation system to operate properly.

An integrally sealed fan compartment 74 is positioned in the upper portion of the holding tank 12 and rests upon a framework supporting stand 76. Inside the compartment 74 is an electric motor 78 and an associated squirrel cage fan 80. The compartment 74 includes an extension portion 82 having parallel air intake and discharge channels 84 and 86, respectively. A downwardly depending tubular portion 88 slides snugly in a coaxial orientation over the upper opening 56 of the large diameter air intake tube 52 below the water line 90. The fan compartment 74 and its internal components can thus be simply lifted out of the holding tank 12 for maintenance without removing the flapper valve assembly 50 and without draining the tank 12. The air discharge channel 86 of the compartment 74 includes a ball check valve 92 which allows airflow only in the direction of air discharge.

The upper end of the inner air discharge tube 66 protrudes through a snugly fitting, cooperable opening 94 into the air discharge channel 86. A rubber valve member 96 is positioned over the opening 94 and is connected to the flush valve float 42 by a wire rod 98 hinged to the extension portion 82 of the fan compartment 74.

During operation of the ventilated toilet, the electric motor 78 is selectively switched on from a manually operated switch or, alternatively, from an automatic weight-actuated switch in the seat 97 of the toilet. The electric motor 78 drives the fan 80 and draws air out of the toilet bowl 10 through the water discharge apertures 26, through the annular discharge channel 22 and the conduit 28, and upwardly through the outer, annular channel of the air intake tube 52. The air is subsequently drawn through the air intake channel 84 of the fan compartment 74 and returned through the air discharge channel 86 of the compartment 74. The ball check valve 92 prevents reverse flow of contaminated air when the motor 78 is turned off. The contaminated air is subsequently forced downwardly through the inner air discharge tube 66 and into the upper siphon portion 20 of the waste duct 16, from where it is discharged into the sewer pipe 18.

When the toilet is flushed, the float 42 of the float valve 40 descends as the water line 90 of the holding tank 12 drops. The rubber valve member 96 falls accordingly to seal the opening 94 of the air discharge tube 66. This prevents air from entering the upper siphon portion of the waste duct 20 and enables the waste duct 16 to operate in its conventional manner to empty the toilet bowl 10 by siphon action. When the toilet is flushed, the flapper 59 is pulled away from the valve opening 60 to allow the water in the holding tank 12 to flush into the toilet bowl 10 through the feed conduit 28, the annular discharge channel 22 and the water discharge apertures 26. If the toilet is flushed while the fan 80 is running, the closing of the discharge tube 66 by the valve member 96 simply stops the air ventilation circulation temporarily until the flushing cycle is completed.

It will be seen that the present invention may be installed in a conventional toilet with only minimal alteration of the pre-existing toilet structure. The only modification to the structural portions of the toilet that is necessary is the installation of the hole 67 passing through the relatively thin porcelain wall 68 between the conduit 28 and the upper siphon portion 20 of the waste duct. This hole 67 is centered upon the flush discharge outlet 30 at the bottom of the holding tank 12 and is therefore easy to install with conventional porcelain drilling tools. The hole 67 need only be large enough to accommodate the lower end of the air discharge tube 64. The hole 67 may be tapped to accommodate a threaded discharge tube 64, or the tube 64 may be sealed with a plastic sealant or in other conventional manners.

Installation of the novel flapper valve assembly 50 is straightforward and is accomplished by simply screwing the assembly into the pre-existing threaded receptacle of the flush discharge outlet 30 at the bottom of the holding tank 12. The fan compartment 74 and its associated motor 78 and fan 80 are thereafter installed by merely placing the fan compartment 74 on the frame supporting structure 76 with the downwardly depending tubular portion 88 being placed over the upper opening 56 of the air intake tube 52.

Although the present invention is described and illustrated by reference herein to a preferred embodiment, it will be understood that various alterations, modifications and substitutions which may be apparent to one skilled departing from the essential spirit of the invention. The scope of the invention is, accordingly, defined by the following claims.

The embodiments of the present invention in which an exclusive claim or privilege is claimed are defined as follows:

1. A ventilated toilet comprising:

a toilet stool and a toilet holding tank, said toilet stool having therein a toilet bowl, said toilet bowl being connected in fluid communication with a sewer discharge line by a waste discharge duct internal to said toilet stool, said waste discharge duct including a siphon portion interposed between said toilet bowl and said sewage discharge line, said toilet holding tank being positioned above and to the rear of said toilet bowl, said holding tank having a water discharge outlet connected in fluid communication with a feed conduit in said toilet stool, said feed conduit being in fluid communication with an annular water discharge channel in the rim of said toilet bowl, said annular discharge channel including a plurality of apertures for discharge of water into said toilet bowl;

fresh water intake valve means and cooperable valve float means for filling said toilet bowl and said holding tank with fresh water and for regulating the level of water in said holding tank;

a flapper valve assembly having a large diameter air intake tube and a small diameter air discharge tube enclosed in said intake tube, said air intake tube and said air discharge tube each having first and second ends, said first end of said intake tube being connected in fluid communication to said water discharge outlet of said holding tank, said first end of said air discharge tube protruding downwardly through said first end of said air intake tube and through said discharge outlet of said holding tank and passing through said conduit in said toilet stool and opening into said siphon portion of said waste duct, said large diameter air intake tube further including a flapper valve adjacent said first end of said intake tube, said flapper valve being selectively operable to admit water from said holding tank into said air intake tube during a flushing cycle; and fan means operably connected to said second end of said air intake tube for withdrawing contaminated air from said toilet bowl through said annular discharge channel, said feed conduit and said air intake tube and pumping said contaminated air downwardly through said air discharge tube into said siphon portion of said waste duct for disposal through said sewer line.

2. The toilet defined in claim 1 further comprising an overflow tube having first and second ends, said overflow tube being operably connected in fluid communication with the interior of said air intake tube adjacent said first end of said air intake tube, said overflow tube extending upwardly from a position adjacent said first end of said air intake tube to an S-shaped water trap integrally formed in said second end of said overflow tube, said S-shaped trap and said second end of said overflow tube terminating in an opening above a predetermined level corresponding to the uppermost water line of said holding tank, and a toilet bowl refill tube operably connected in fluid communication with said fresh water intake valve and extending from said intake valve means to said opening in said second end of said overflow tube, said refill tube operating to refill said toilet bowl after each flushing cycle by conducting water from said fresh water intake valve means into said overflow tube and thence into said toilet bowl through said overflow tube, said air intake tube, said feed conduit and said annular discharge channel.

3. The toilet defined in claim 2 wherein said fan means comprises an electric fan housed in a watertight fan compartment positioned in an upper portion of said holding tank, said compartment including an air intake channel and an air discharge channel integrally formed in said compartment and connected respectively to said second end of said air intake tube and said second end of said air discharge tube, said electric fan being interposed between said air intake channel and said air discharge channel and operating to pump air from said air intake channel into said air discharge channel.

4. The toilet defined in claim 3 further comprising a valve means operably interposed between said second end of said air discharge tube and said air discharge channel of said fan compartment, said valve means being operably connected to said holding tank float means to close said air discharge tube to said air discharge channel during a flushing cycle and to open said discharge tube to said air discharge channel between flushing cycles upon the water level in said holding tank rising to said predetermined level.

5. The toilet defined in claim 4 wherein said fan compartment includes a laterally offset extension portion having therein extensions of said air intake channel and said air discharge channel, said extension portion further including a downwardly depending tubular portion coaxially slidable over said second end of said air intake tube to thereby connect in fluid communication said air intake channel with said air intake tube, and said extension portion further including means for receiving in substantially sealed relationship said second end of said air discharge tube to thereby connect in fluid communication said air discharge channel of said extension portion with said air discharge tube.

6. The toilet defined in claim 5 further comprising a one-way valve means interposed in said fan compartment for maintaining a unidirectional flow of air from said intake channel through said air discharge channel.

7. The toilet as defined in claim 6 wherein said one-way valve means comprises a ball check valve interposed in said air discharge channel of said fan compartment.

8. In a toilet having a toilet stool and an associated water holding tank, said toilet stool having a toilet bowl connected to said water holding tank by an annular water discharge channel in the rim of said toilet bowl and a plurality of discharge apertures opening from said channel into said toilet bowl, and a feed conduit connecting said annular discharge channel in fluid communication with said holding tank, said conduit extending rearwardly from said toilet bowl and opening upwardly into said holding tank, said toilet bowl being connected in fluid communication with a sewer line by a waste discharge duct internal to said toilet stool, said waste discharge duct having a siphon portion positioned under said feed conduit, said holding tank including a valve float means and water intake valve means for regulating the water level in said holding tank, an improved ventilation system comprising:

an air intake tube having upper and lower ends extending upwardly from the interior bottom of said holding tank and maintained in fluid communication at its lower end with said feed conduit of said toilet stool, a relatively smaller diameter air discharge tube having upper and lower ends, said discharge tube being coaxially positioned within said air intake tube and extending downwardly through said lower end of said air intake tube and through said feed conduit, said discharge tube being connected at its lower end in fluid communication with said siphon portion of said waste discharge duct, said air intake tube having offset to one side of said lower end thereof a flapper valve assembly including a buoyant flapper and a cooperable flapper valve opening, said lower end of said air intake tube further being connected in fluid communication to a lower end of a holding tank overflow tube, and a fan means in said holding tank, said fan means being operably connected to said upper end of said air intake tube and said upper end of said discharge tube, said fan means being operable to pump air from said air intake tube into said air discharge tube between flushing cycles to thereby withdraw air from said toilet bowl through said annular discharge channel and said feed conduit and said air intake tube and discharge said air through said air discharge tube to said sewer line.

9. The ventilation system defined in claim 8 further including a one-way valve means interposed between said upper end of said air intake tube and said upper end of said air discharge tube to prevent air from flowing from said sewer line into said toilet bowl.

10. The ventilation system defined in claim 8 wherein said holding tank overflow tube includes an upper end having an S-shaped water trap having a terminal opening at a predetermined level corresponding to the uppermost water level of said holding tank.

11. The system defined in claim 10 further including a valve means interposed between said fan means and said upper end of said air discharge tube, said valve means being operably connected to said valve float means to close said air discharge tube to said fan means during a flushing cycle and to open said air discharge tube to said fan means between flushing cycles.

* * * * *